US008991119B1

(12) United States Patent
Bracci

(10) Patent No.: US 8,991,119 B1
(45) Date of Patent: Mar. 31, 2015

(54) FLUID IMPERMEABLE BARRIER

(71) Applicant: Tim Bracci, Brooklyn, NY (US)

(72) Inventor: Tim Bracci, Brooklyn, NY (US)

( * ) Notice: Subject to any disclaimer, the term of this patent is extended or adjusted under 35 U.S.C. 154(b) by 0 days.

(21) Appl. No.: 14/013,508

(22) Filed: Aug. 29, 2013

(51) Int. Cl.

| | |
|---|---|
| ***E06B 3/28*** | (2006.01) |
| ***E04H 9/14*** | (2006.01) |
| ***E06B 3/30*** | (2006.01) |
| ***E06B 7/14*** | (2006.01) |

(52) U.S. Cl.
CPC ..... *E04H 9/145* (2013.01); *E06B 3/308* (2013.01); *E06B 7/14* (2013.01)
USPC ..... 52/203; 52/202; 52/506.01; 52/208; 52/476; 49/56; 49/394; 49/465

(58) Field of Classification Search
USPC ..... 52/202, DIG. 12, 204.62, 208, 476, 52/506.01, 656.6, 656.7, 780, 203; 49/62, 49/464, 56, 57, 61, 63, 394, 463, 465; 292/246, 247, 248, 249, 250
See application file for complete search history.

(56) References Cited

U.S. PATENT DOCUMENTS

| | | | | |
|---|---|---|---|---|
| 2,319,525 | A * | 5/1943 | Waterman | 292/246 |
| 2,599,725 | A * | 6/1952 | Rust et al. | 160/328 |
| 3,534,992 | A * | 10/1970 | Swanson | 292/113 |
| 3,861,081 | A * | 1/1975 | Maskell | 49/70 |
| 4,300,794 | A * | 11/1981 | Dunsmoor | 292/247 |
| 4,333,271 | A | 6/1982 | DePaolo et al. | |
| 4,454,691 | A | 6/1984 | Mitchell | |
| 4,991,349 | A * | 2/1991 | Barthelemy | 49/61 |
| 5,347,775 | A | 9/1994 | Santos | |
| 5,430,982 | A | 7/1995 | Bane | |
| 5,487,243 | A * | 1/1996 | Hale et al. | 52/202 |
| 5,603,190 | A | 2/1997 | Sanford | |
| 5,918,430 | A | 7/1999 | Rowland | |
| 5,941,031 | A | 8/1999 | Fullwood | |
| 5,943,832 | A * | 8/1999 | Russell | 52/202 |
| 6,125,905 | A * | 10/2000 | Woodside et al. | 160/67 |
| 6,189,264 | B1 * | 2/2001 | DiVeroli | 49/57 |
| 6,205,713 | B1 * | 3/2001 | Thompson et al. | 49/465 |
| 6,257,631 | B1 * | 7/2001 | Sokurenko et al. | 292/247 |
| 6,334,282 | B1 * | 1/2002 | Wood | 52/202 |
| 6,341,455 | B1 | 1/2002 | Gunn | |
| 6,506,112 | B1 * | 1/2003 | Halbleib et al. | 454/225 |
| 6,931,802 | B2 * | 8/2005 | Jones et al. | 52/202 |
| 7,243,463 | B1 * | 7/2007 | Lucero | 49/465 |
| 7,337,582 | B1 * | 3/2008 | Klotz | 49/465 |
| 7,546,710 | B2 * | 6/2009 | Abbott | 52/202 |
| 7,797,891 | B2 * | 9/2010 | Michaud | 52/213 |
| 8,001,735 | B2 * | 8/2011 | Fisher | 52/202 |

(Continued)

FOREIGN PATENT DOCUMENTS

| | | |
|---|---|---|
| GB | 2458211 | 9/2009 |
| GB | 2491019 | 11/2012 |
| WO | WO2012105911 | 8/2012 |

*Primary Examiner* — Robert Canfield
*Assistant Examiner* — Matthew Gitlin
(74) *Attorney, Agent, or Firm* — Michael I. Kroll

(57) ABSTRACT

A liquid resistant barrier for structural openings such as doors, windows, vents, or the like for use during floods or storms is disclosed. A barrier frame is placed within and about the periphery of the opening, with a gasket located on the structural side, to form a seal. A barrier frame cover, with a corresponding barrier frame cover gasket, is placed over the barrier frame and compression fittings used to hold them together. The gaskets form a seal that is impermeable to liquids and the barrier frame cover prevents damage by flotsam or dynamic pressure.

13 Claims, 12 Drawing Sheets

(56) References Cited

U.S. PATENT DOCUMENTS

| | | | | |
|---|---|---|---|---|
| 8,272,117 | B2 * | 9/2012 | Michaud | 29/451 |
| 8,479,462 | B1 * | 7/2013 | Sahadeo et al. | 52/203 |
| 8,613,171 | B2 * | 12/2013 | Dudash | 52/213 |
| 2001/0005995 | A1 * | 7/2001 | Subliskey | 70/89 |
| 2002/0104275 | A1 * | 8/2002 | Harrison | 52/202 |
| 2004/0060253 | A1 * | 4/2004 | Elsing | 52/384 |
| 2008/0148644 | A1 * | 6/2008 | Valente | 49/466 |
| 2009/0266013 | A1 * | 10/2009 | Motosko et al. | 52/203 |
| 2011/0010997 | A1 * | 1/2011 | Kislov | 49/141 |

* cited by examiner

FLUID IMPERMEABLE BARRIER

BACKGROUND OF THE INVENTION

1. Field of the Invention

The present invention relates generally to liquid barriers and, more specifically, to a impermeable covering mountable on a structure, specifically for an aperture, such as door, window, vent, or other opening to prevent liquid passage through the aperture.

2. Description of the Prior Art

There are other barrier devices designed to prevent the ingress of fluids into a structure. While these barrier devices may be suitable for the purposes for which they where designed, they would not be as suitable for the purposes of the present invention as heretofore described.

It is thus desirable to provide an aperture barrier for a structure having a frame and gasket mountable over a structural aperture to provide a watertight seal between the frame and the structure and also to provide a rigid impermeable cover releasably mountable to the frame with a closed cell gasket between the liquid impermeable cover and the frame.

It is further desirable that the rigid impermeable cover be manufactured from a material selected from the group of wood, plastic and metal.

SUMMARY OF THE PRESENT INVENTION

Many building envelopes are susceptible to water damage through their apertures, such as doors, windows, vents, or other openings whether at grade or below grade. Historically, these apertures were not designed with seals to prevent standing water from leaking around them, resulting in a situation that can quickly degrade catastrophically when standing water, even a few inches, containing flotsam driven by wind and current, compromises the existing aperture device.

The idea for this invention arose from reviewing the carnage of Superstorm Sandy on the beaches in NY. Flood damage to buildings was largely due to breaches of the building thru windows and doors that did not fail intrinsically but failed where they were structurally attached to the building. Glass breakage did account for some building flooding but in many cases the force of the water actually pushed doors and windows into the interior of the house without actually breaking the door, window or glass.

There are many generally accepted strategies for protecting apertures from storm water and wind damage. They include the use of plywood, sandbags, tape and other means that are applied to the door and window in the attempt to strengthen it against both wind and water.

Each of these strategies when deployed alone or in combination still have deficiencies that compromise their effectiveness. The use of plywood alone failed due to mechanical fasteners not being strong enough and the fact that the plywood did not form a water tight seal with the wall of the surrounding building—protecting the aperture from hydrostatic pressure. Sandbags alone also failed as they did not form a watertight seal and they were subject to flotsam that compromised their integrity and allowed erosion of the sandbag. Tape is commonly used to keep glass from shattering and offers little protection from water at all. Combinations of these strategies show promise but limitations in installation and deployment compromised their effectiveness resulting in significant loss.

It was clear that combinations of protection were needed to overcome the effects of moving water, standing water and debris that could be part of the moving flood waters.

Household protection is needed to combat these multiple problems and be easy and quick for the building operator to deploy.

Each of these issues is addressed by the fluid impermeable barrier of the present invention for a door, window, vent, or other type of opening.

The frame attached to the building wall allows a protective cover to evenly compress a gasket material to form a watertight seal. The cover itself protects the aperture and gasket from the dynamic forces of the water and the flotsam that might cause major damage.

Deployment of plywood, sandbags and other improvised protective measures takes time and is a drain on local building resources such as plywood. Additionally, these materials themselves may become flotsam in flood waters. Once the frame is attached to the building, deployment of the cover is a simple operation that is carried out quickly allowing the building operator to focus on other important issues in the face of the coming storm or flood.

The idea to position the cover by use of a channel allows for easy deployment and uniform transmission of the compressive force. Other methods to position the cover have been tried and are admissible for use with this device.

The cover is attached thru compressive force to ensure the gasket maintains its integrity. Several compressive attachments have been tried including bolts and nuts, rotating cams, toggles and other means to compress a gasket.

Numerous tests of the various components have been tried and are available for review. Frame and cover material, gasket material and compression devices have been examined. The preferred embodiments illustrated are the result of development of all these components that will allow the building operator to quickly and easily deploy this level of protection.

A primary object of the present invention is to provide a fluid impermeable barrier mountable over a structural aperture in whole or in part to prevent the passage of fluid through said structural aperture.

Yet another object of the present invention is to provide a fluid impermeable barrier mountable over a structural aperture designed to prevent passage of fluid and to prevent driven flotsam from breaching the fluid impermeable barrier.

Still yet another object of the present invention is to provide a fluid impermeable barrier having a frame mountable to the peripheral opening of a structural aperture.

An additional object of the present invention is to provide a fluid impermeable barrier wherein the frame may include security bars.

A further object of the present invention is to provide a fluid impermeable barrier having a gasket positioned between the structural aperture and the mountable frame.

A yet further object of the present invention is to provide a fluid impermeable barrier having a cover mountable to the frame.

A still yet further object of the present invention is to provide a fluid impermeable barrier wherein said cover is manufactured from a group of materials including wood, plastic and metal.

Another object of the present invention is to provide a fluid impermeable barrier having a compression fitting whereby the cover is securely held to the frame under pressure.

Additional objects of the present invention will appear as the description proceeds.

The present invention overcomes the shortcomings of the prior art by providing a barrier for building structural openings comprising a fluid impermeable frame that can be mounted onto the periphery of a structure's door, window, vent, or other opening to form a waterproof seal between the frame and the rim of the opening and a frame cover that is freely attachable and detachable and that can be compressively fastened to the frame opening to create a impermeable and secure barrier over the door, window, vent, or other opening.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
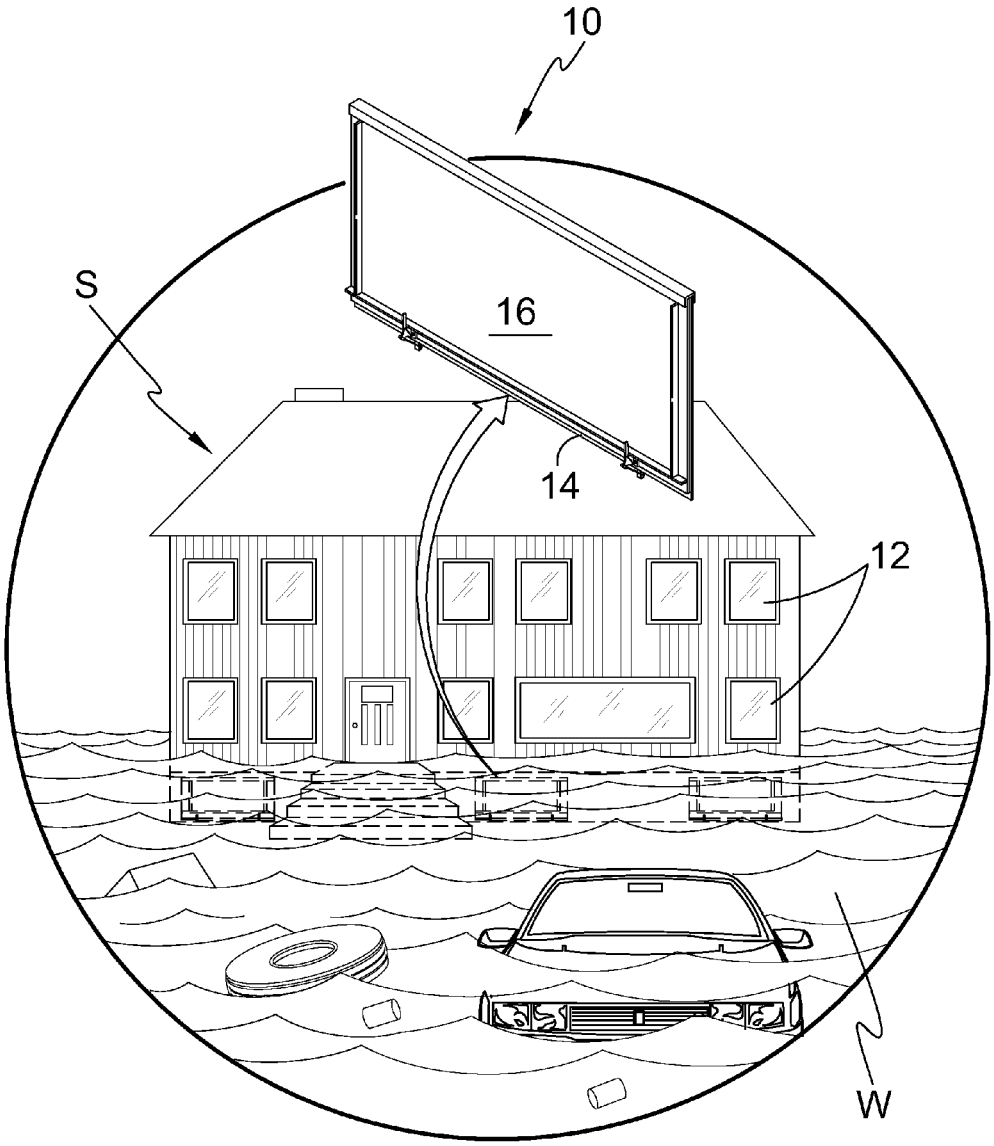
FIG. 1 is an illustrative view of the fluid impermeable barrier of the present invention in use.

Turning now descriptively to the drawings, in which similar reference characters denote similar elements throughout the several views, the figures illustrate the use of the present invention. With regard to the reference numerals used, the following numbering is used throughout the various drawing figures.

10 impermeable barrier
12 structural openings
14 barrier frame
14A barrier frame with security bars
16 frame cover
18 barrier frame gasket
20 cover gasket
22 frame cover channel
24 frame cover compression device
26 barrier frame mounting apertures
28 barrier frame hinge lock tab
30 hinge lock clip
32 hinge lock clip mounting bracket
34 hinge lock clip mounting bracket hardware
36 hinge lock clip handle
38 hinge lock clip latch
40, 42 hinge lock clip pivot points
44 hinge lock clip security lock aperture
46 second lock clip
48 second lock clip mounting bracket
50 second lock clip mounting bracket apertures
52 second lock clip handle
54 second lock clip latch
56 second lock clip pivot point
58 barrier frame latch tab
60 barrier frame latch tab latch receiver notch
62 cam latch
64 cam latch mounting bracket
66 cam latch mounting bracket apertures
68 cam latch handle
70 cam latch pivot point
72 cam latch engaging member
74 barrier frame cam latch mounting bracket
76 barrier frame cam latch mounting bracket apertures
78 bracket latch engagement receiver
80 barrier frame upper lip
82 barrier frame outward offset distance
84 plywood frame cover
86 plywood frame gasket
88 plywood frame mounting apertures
90 plywood frame mounting bolt
92 plywood frame mounting nut
100 stiffener
W water
S structure
A1 hinge lock clip latch activation arrow

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the fluid impermeable barrier 10 of the present invention in use. The present invention is a barrier 10 for building S structural openings 12, such as doors, windows, vents and other types of openings that were not designed to be submerged under water (indicated at W) or to withstand water pressure placed on these apertures or openings. the present invention 10 provides a fluid impermeable frame 14, discussed below, that can be mounted onto the periphery of a structure S door, window, vent, or other opening 12 to form a waterproof seal between the frame 14 and the rim of the door, window, vent, or other opening 12 where then, when needed, a provided attachable and detachable fluid impermeable frame cover 16 can be compressively fastened over the frame opening creating a fluid impermeable barrier 10 over said door, window, vent, or other opening 12.

Figure 2:
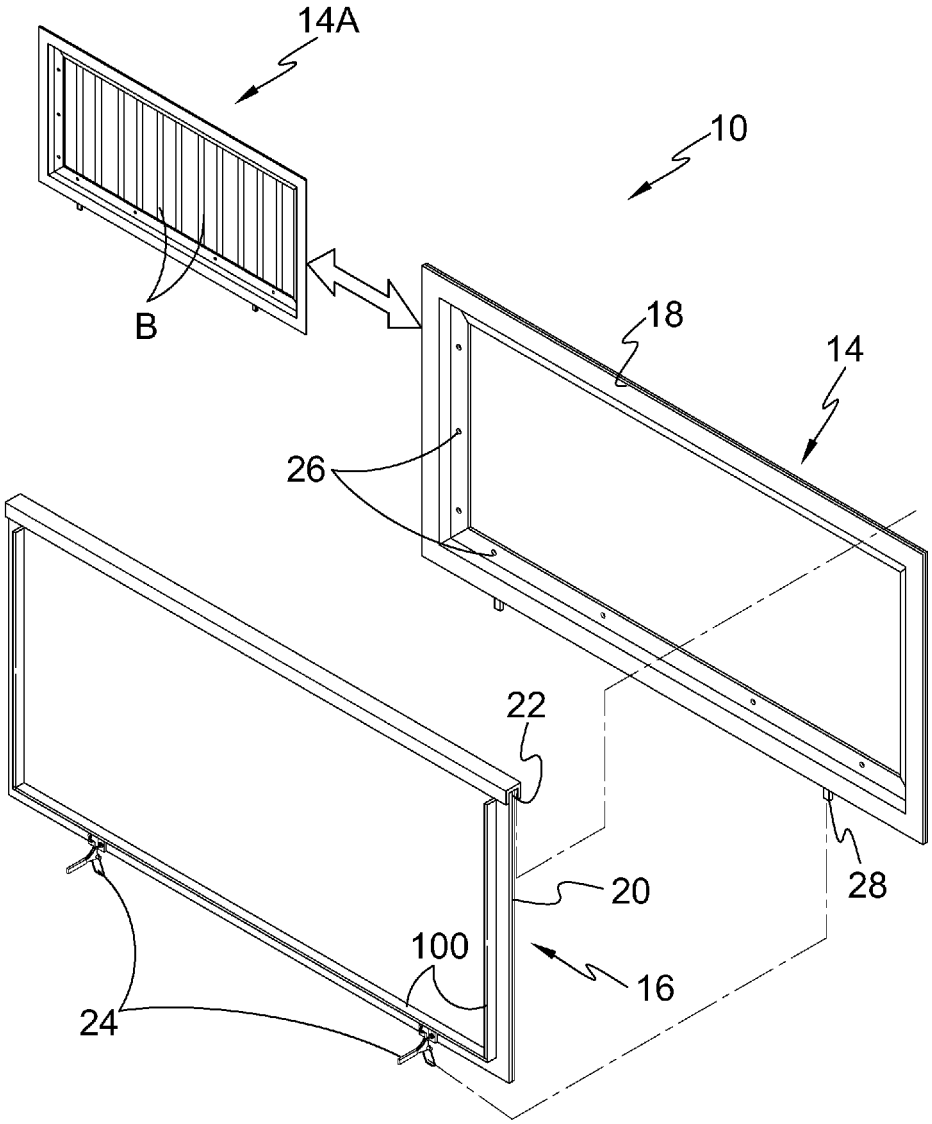
FIG. 2 is an exploded view of an embodiment of the structural building barrier of the present invention.

Referring to FIG. 2, shown is an exploded view of an embodiment of the structural building barrier 10 of the present invention. Shown is the fluid impermeable barrier 10 for door, window, vent, or other opening 12 comprising a frame 14 that can be installed onto the existing periphery (detailed further below) of a door, window, vent, or other opening 12 either temporarily or permanently, and a frame cover 16 that when attached to the barrier frame 14 provides a waterproof seal over the door, window, vent, or other opening 12. The barrier frame 14 includes a barrier frame gasket 18 and, in the embodiment seen in the Figure, also includes mounting apertures indicated at 26 for securing the barrier frame 14 to the structure. It should be noted that the mounting apertures 26 are only one method that could be used to secure the barrier frame to the structure: other securement means would occur to a skilled practitioner. The frame cover 16 includes a frame cover gasket, indicated at 20 and optionally provides for cover stiffener 100. The frame cover 16 also includes a channel 22 and compression device 24, both of which will be discussed in further detail below. Alternately provided is a barrier frame 14A having security bars B where desired.

Figure 3:
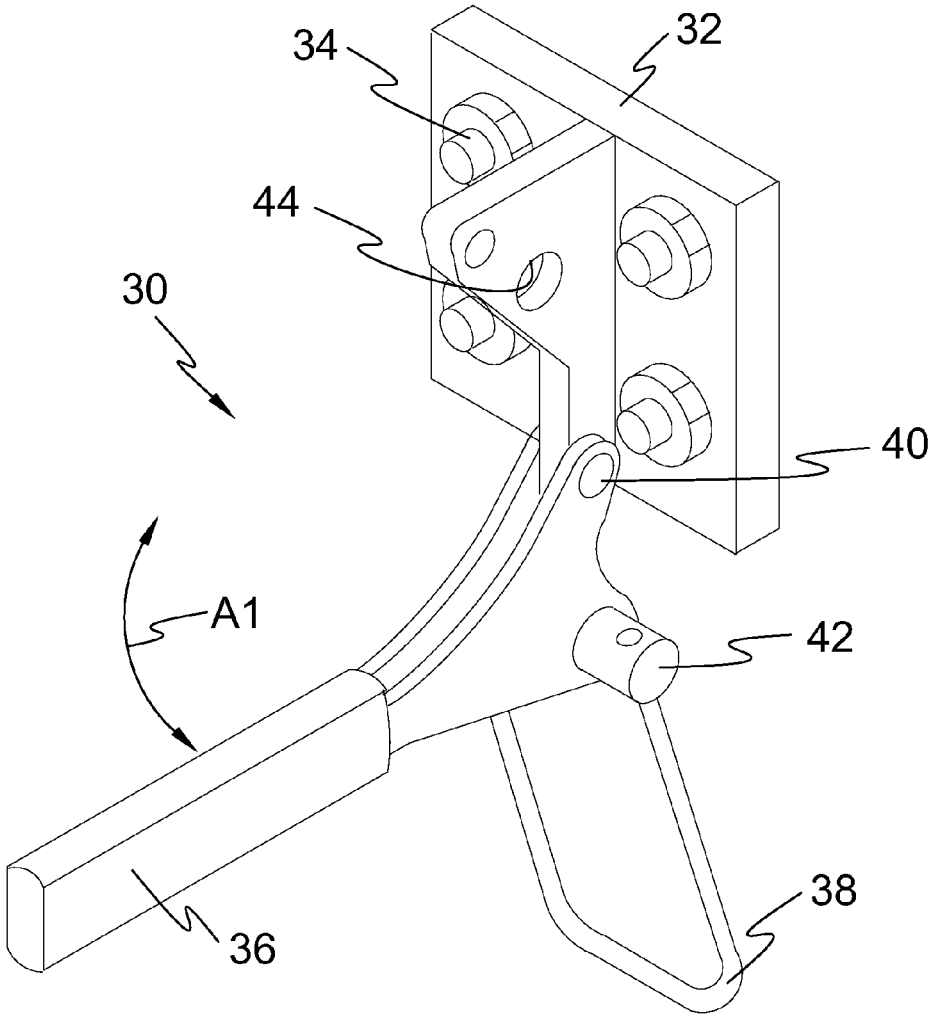
FIG. 3 is an enlarged view of an enablement of a compression device for the present invention.

Referring to FIG. 3, shown is an enlarged view of one enablement of the compression device 24 for the present invention. The present invention provides for at least one compression device 24 mounted to either the fluid impermeable barrier frame 14 or barrier frame cover 16 for applying a force to create an impermeable seal between the cover 16 and frame 14. In this Figure the compression device 24 is a hinge lock clip 30 having a mounting bracket 32, mounting bracket hardware 34, a handle 36, a latch 38, two pivot points 40, 42, and a security lock aperture 44. The hinge lock clip 30 is attached to the frame cover 16 through mounting bracket 32 and mounting hardware 34 and the latch 38 engages the locking tab 28 (seen in FIG. 2) of the barrier frame 14. The handle is moved as indicated by directional arrow A1 about pivot points 40, 42 thus compressing the frame cover gasket 20 between the barrier frame 14 and the frame cover 16. If desired a lock (not shown) may be inserted through aperture 44 to prevent unauthorized removal of the frame cover 16.

Figure 4:
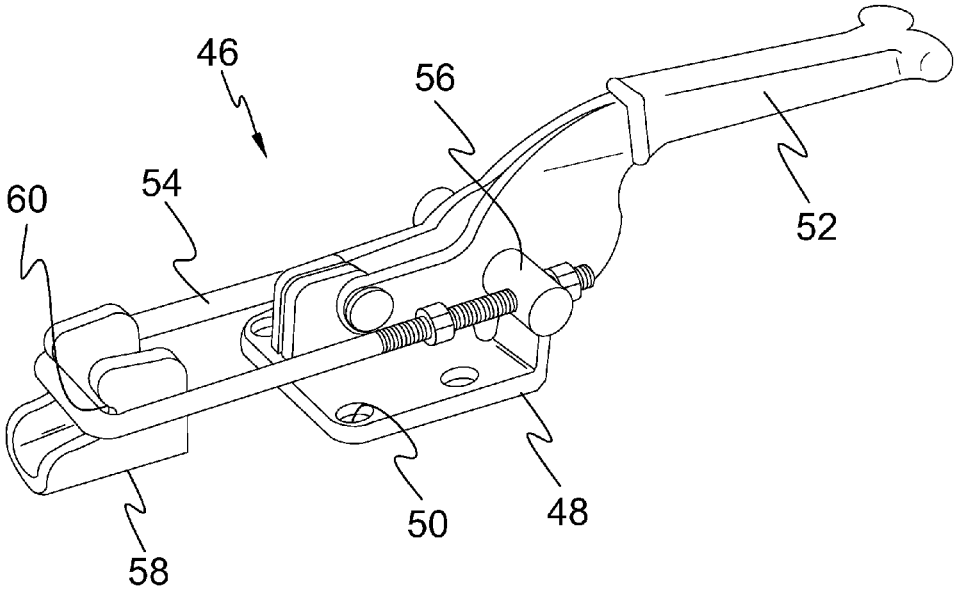
FIG. 4 is an illustrative view of the present invention in use.

Referring to FIG. 4, shown is an enlarged view of another enablement of the compression device 24 for the present invention. In this second embodiment 46 of the device shown in the Figure, the second lock clip 46 includes a mounting bracket 48, mounting bracket apertures 50, a handle 52, a latch 54, and pivot point 56. Engaging the latch 54 is a barrier frame latch tab 58 secured to the barrier frame 14 (not shown in this Figure). Barrier frame latch tab 58 includes latch receiver notch 60.

Figure 5:
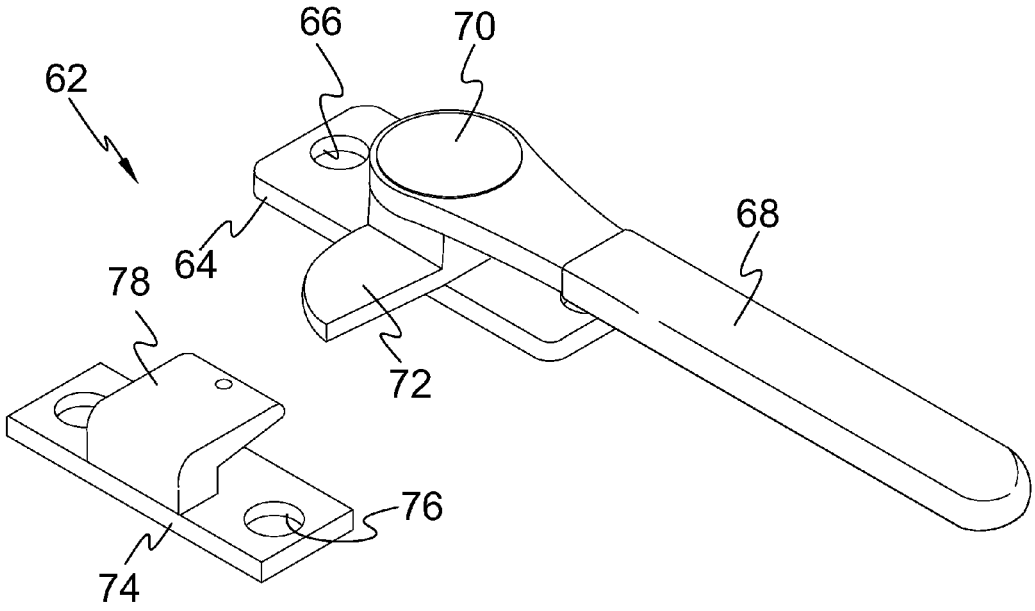
FIG. 5 is an enlarged view of still another enablement of a compression device for the present invention.

Referring to FIG. 5, shown is an enlarged view of still another enablement of a compression device for the present invention. In this embodiment of the compression device 24, it consists of a cam latch 62 with a mounting bracket 64, including mounting bracket apertures 66. The handle 68 rotates on a pivot point 70 and carries an engaging member 72. The engaging member 72 fits to cam latch engagement receiver 78, which is, as seen, is integral with barrier frame cam latch mounting bracket 74 which, in turn, is held to barrier frame 14 through the mounting bracket apertures 76.

It should be understood that in all of the various configurations of the compression device 24 discussed above, the fitting receivers and corresponding engagement members could be placed either on the barrier frame 14 or the barrier cover 16 as desired, without departing from the spirit of the invention. The interengaging portions of the various compression device 24 could be mounted on the top edge or the side edges of the barrier frame 14 and/or the barrier frame cover 16 as is desired or convenient.

Figure 6:
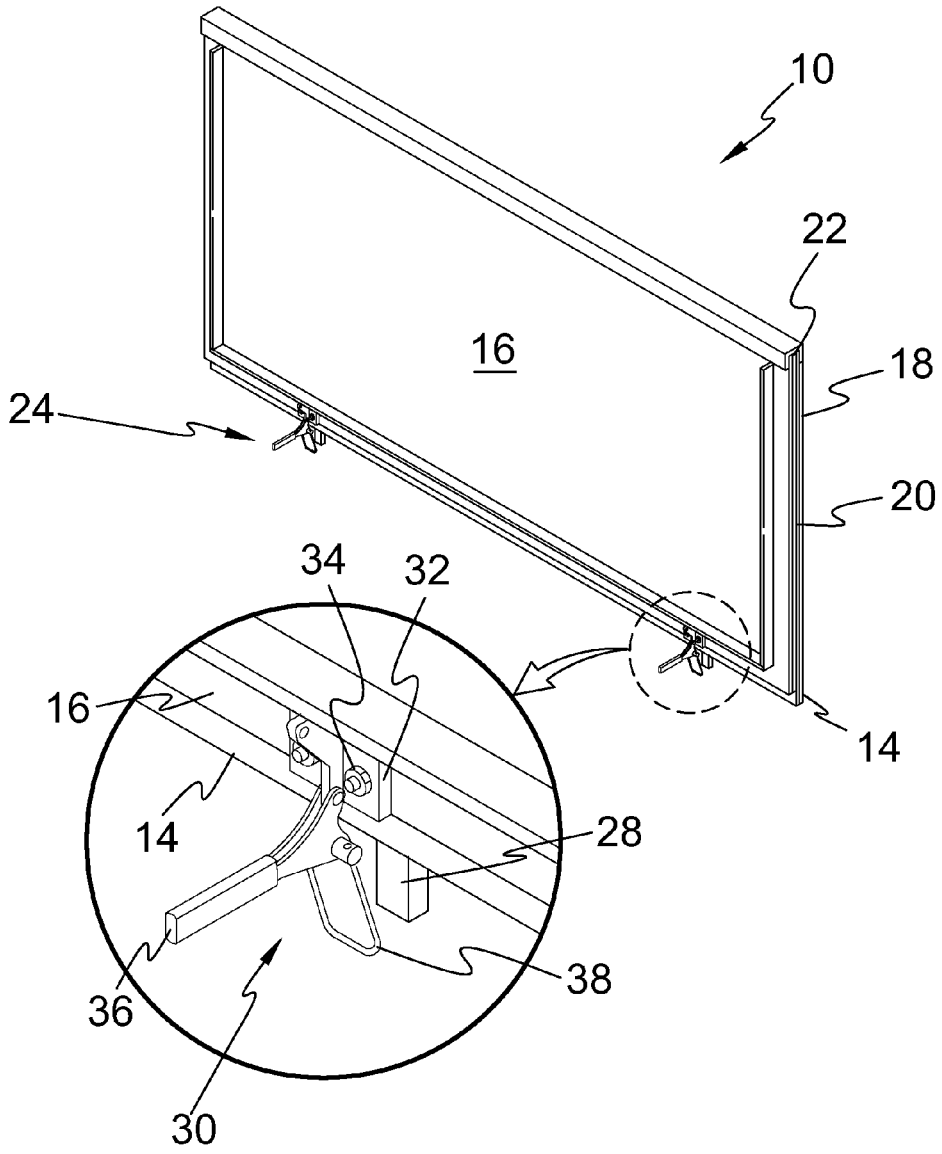
FIG. 6 is an illustrative view of the present invention.

Referring to FIG. 6, shown is an illustrative view of one embodiment of the present invention. Shown is the fluid impermeable barrier 10 having the hinge lock clip embodiment 30 of a compression device 24 for applying a force between the barrier frame 14 and the barrier cover 16 that will compress the frame cover gasket 20 between the cover 16 and frame 14. Also seen in the Figure and discussed further below are the barrier frame gasket 18 and the frame cover channel 22. As can be seen, the hinge lock clip 30 is shown in the unlocked position. Hinge lock clip latch 38 is positioned to engage the barrier frame hinge lock tab 28.

Figure 7:
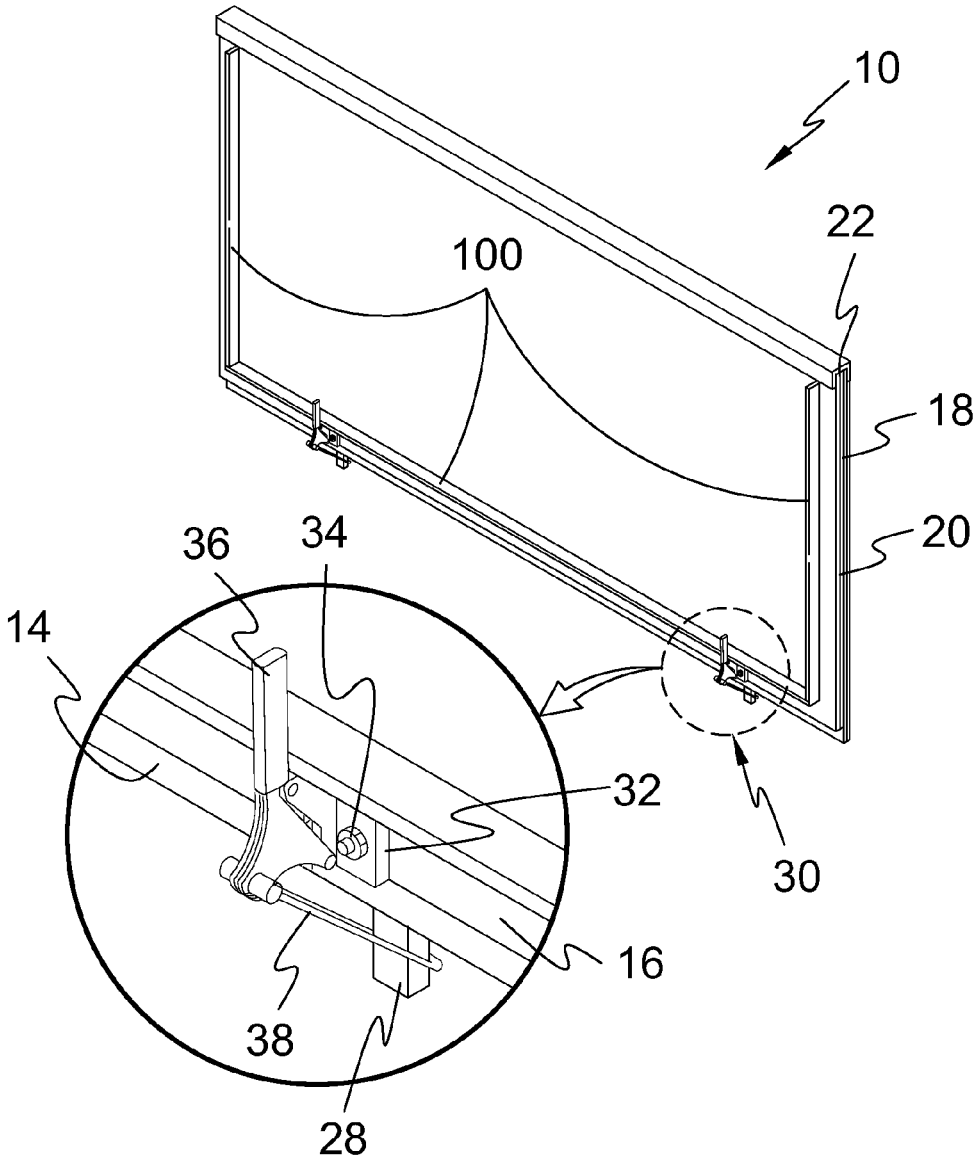
FIG. 7 is a side view of a latched fluid impermeable barrier of the present invention engaged.

Referring to FIG. 7, shown is an illustrative view of the present invention 10 similar to the view as seen in FIG. 6 with the hinge lock clip 30 in the locked position, wherein handle 36 is now substantially upright and the frame cover gasket 20 is compressed against barrier frame 14 to form a tight seal, impermeable to liquids.

Figure 8:
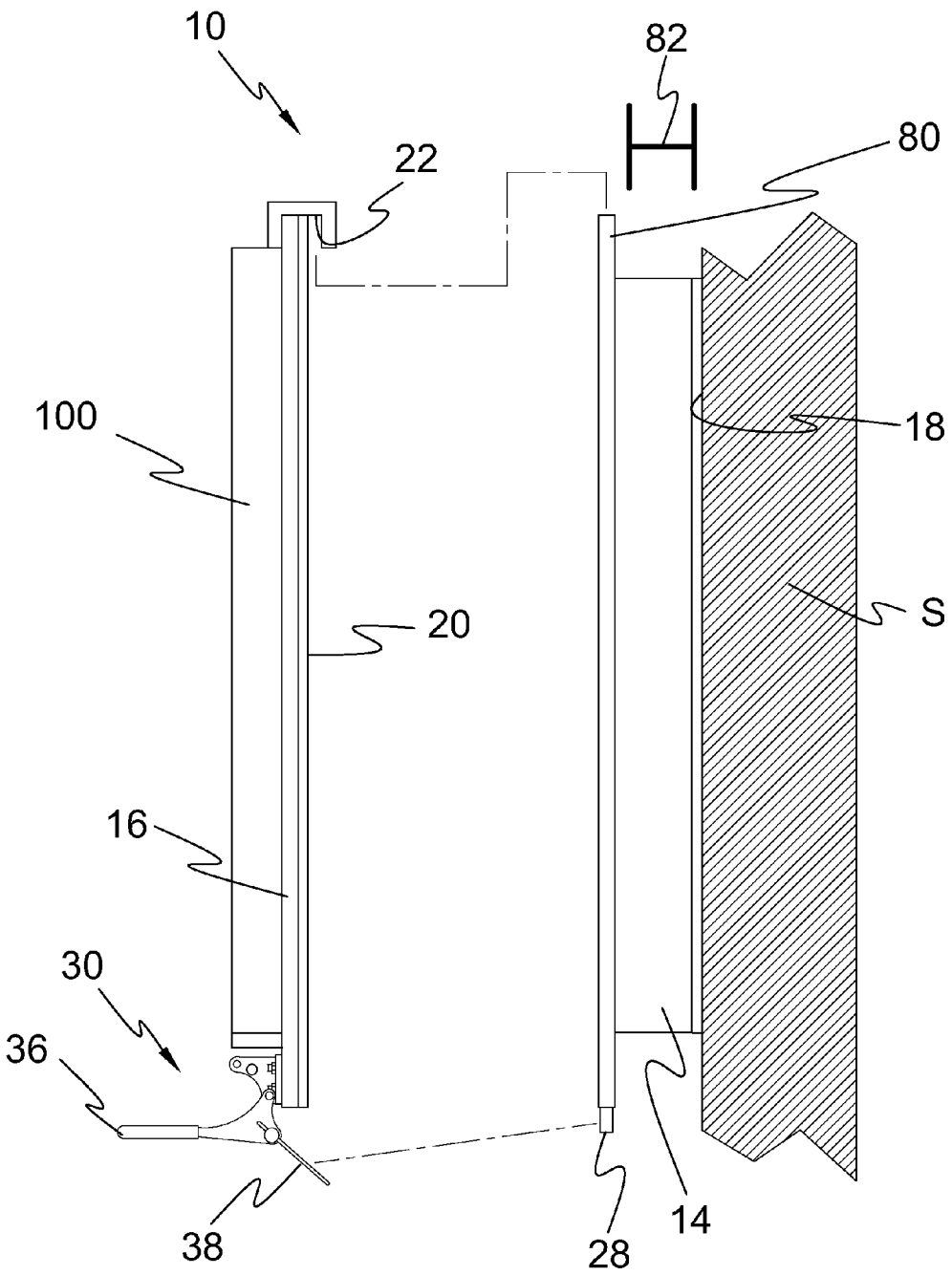
FIG. 8 is a side exploded view of the impermeable barrier of the present invention.

Referring to FIG. 8, shown is an exploded side view of the impermeable barrier 10 for a building door, window, vent, or other opening. Seen in the Figure is the barrier frame 14 which is mountable to the periphery of an existing door, window, vent, or other opening (indicated at 12 in FIG. 1) in an existing structure S. The barrier frame 14 has a first, inner side with the barrier frame gasket 18 disposed thereon, and a second, outward side, which is adapted to receive the barrier frame cover 16 that compressively mounts to the barrier frame 14 making a waterproof seal over the covered door, window, vent, or other opening in the structure S. This compressive mounting is made up of a channel 22 that fits over the upper lip 80 of the barrier and, in the embodiment shown in this Figure, the hinge lock clip 30, with its handle 36 and latch 38, where the latch engages the barrier frame hinge lock tab 28. Upper lip 80 is a portion of the lip that extends substantially completely around the second, outward side of the barrier frame 14. Note also that the barrier frame 14 extends outwardly a short distance from the structure S with the barrier frame outward offset distance being indicated at 82. The impermeable barrier cover 16 has a first inner side with a frame cover gasket 20 disposed thereon, and a second, outer side. The barrier cover 16 is preferably manufactured of a rigid material to resist a load, whether sheer, tensile or compressive forces and alternately provides a cover stiffener comprising one or more longitudinal or lateral flanges 100 spaced away from the cover edge to resist deformation of the cover by flotsam within storm/flood waters. The barrier frame gasket 18 and frame cover gasket 20 are made from a compressible, waterproof, flexible material: various polymer or rubber materials would serve, the object of the gaskets 18, 20 being to provide a secure and impermeable seal against liquids at the periphery of the selected opening 12.

Figure 9:
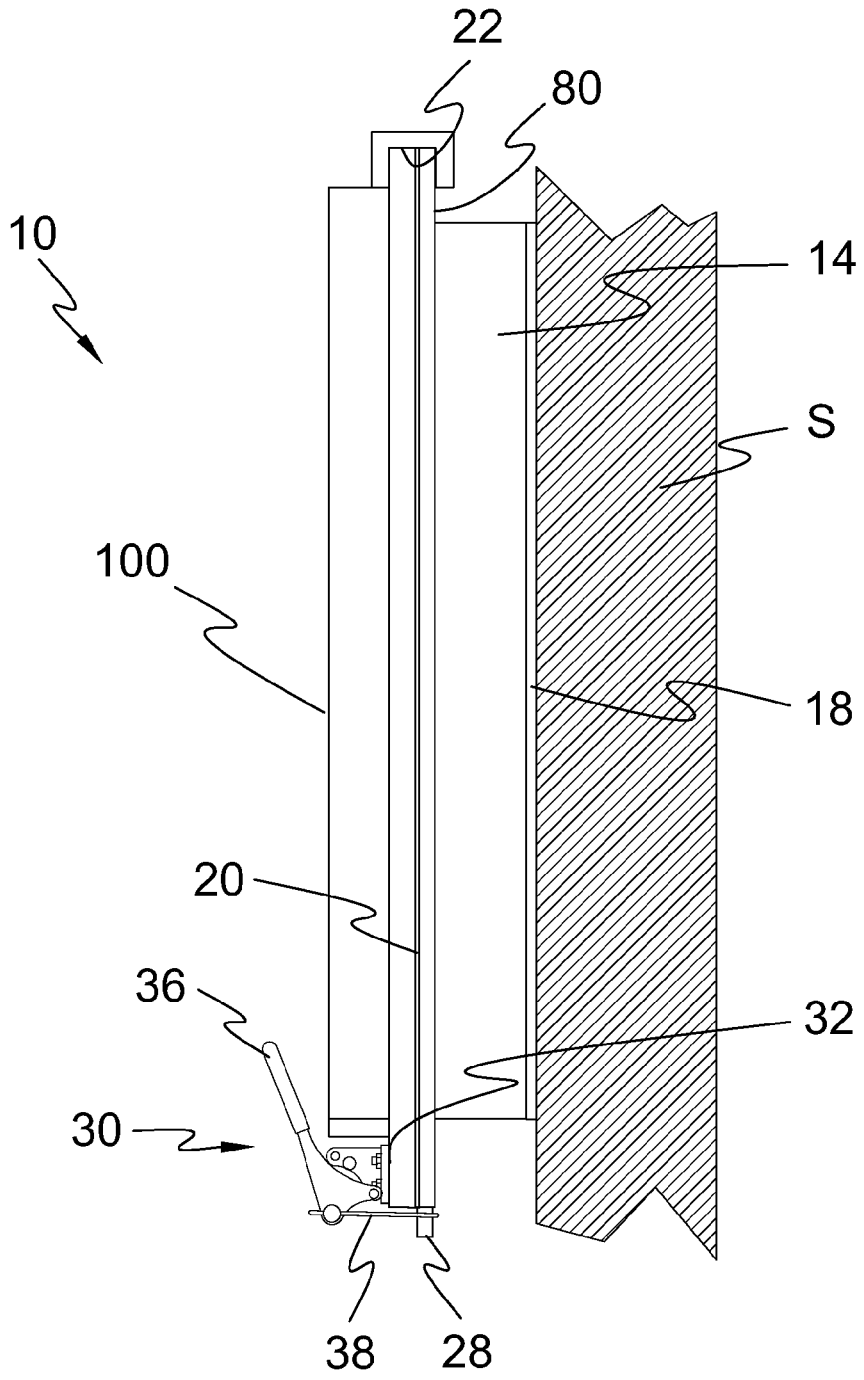
FIG. 9 is a side view of a latched fluid impermeable barrier of the present invention engaged.

Referring to FIG. 9, shown is a side view of the latched fluid impermeable barrier as seen in FIG. 8 engaged in a locked configuration. The impermeable barrier 10 of the instant invention provides a barrier frame 14 mountable to the periphery of an existing door, window, vent, or other opening 12 and further provides a barrier frame cover 16 that compressively mounts to the barrier frame 14 making a waterproof seal over the covered door, window, vent, or other opening as described herein. The impermeable barrier frame 14 further provides a lipped rail-like flange 80 with the cover having a correspondingly positioned channel 22 so that when the cover channel 22 is placed over the rail and latched by the compression fitting (indicated at 30 in the Figure) the closed cell cover frame gasket 20 is compressed to create a waterproof seal between the cover 16 and frame 14.

Figure 10:
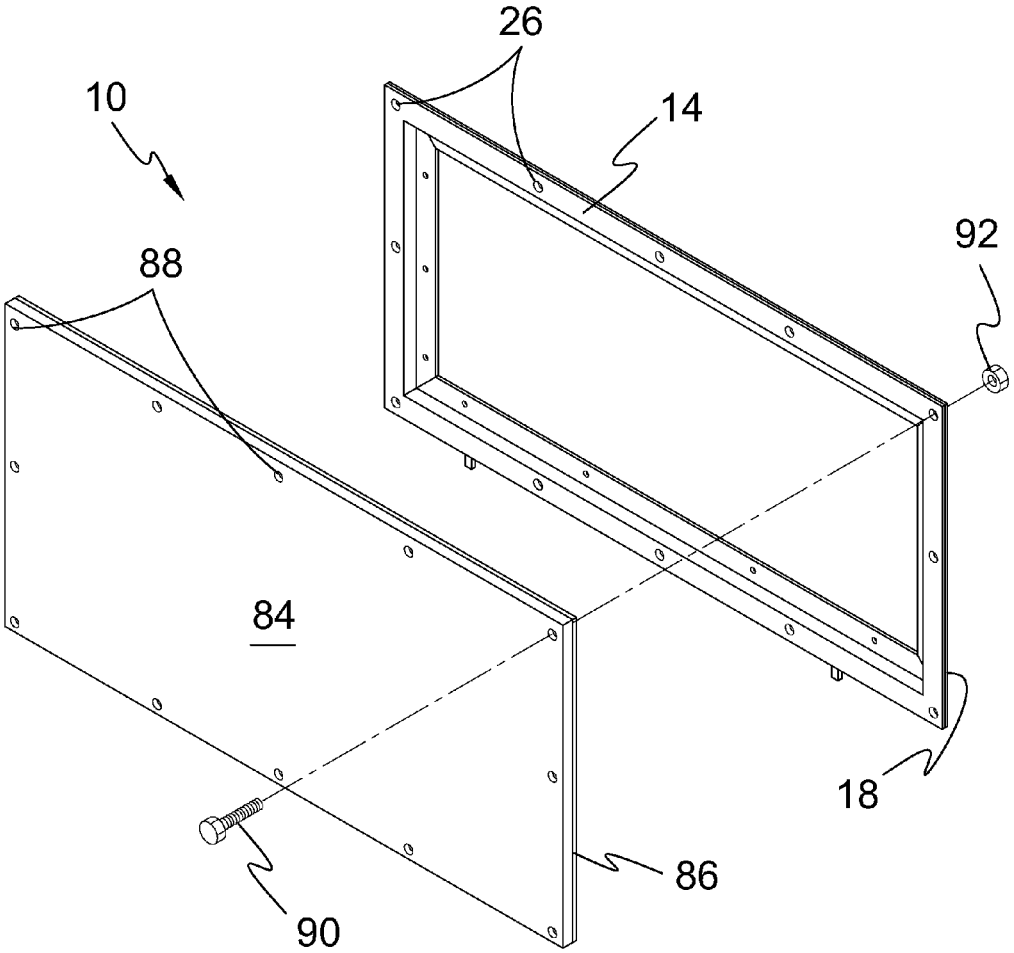
FIG. 10 is an exploded view of the additional element of the present invention.

Referring to FIG. 10, shown is an exploded view of another embodiment of the present invention. There is seen a fluid impermeable barrier 10 for door/window/vent/opening comprising a frame 14 that can be installed onto the existing periphery of a door, window, vent, or other opening (12, seen in FIG. 1) either temporarily or permanently. In this embodiment, the barrier 10 also includes a plywood frame cover 84 that when attached to the barrier frame 14 provides a waterproof seal over the door, window, vent, or other opening. The plywood frame cover 84 includes a plywood frame gasket 86 and also includes a plurality of mounting apertures 88 therethrough where a mounting bolt 90 and mounting nut 92 serve to attach frame cover 84 to barrier frame 14. Note that barrier frame outward offset distance 82, as seen in FIG. 8 allows for the installation of the mounting bolt and nut 90, 92 respectively.

Figure 11:
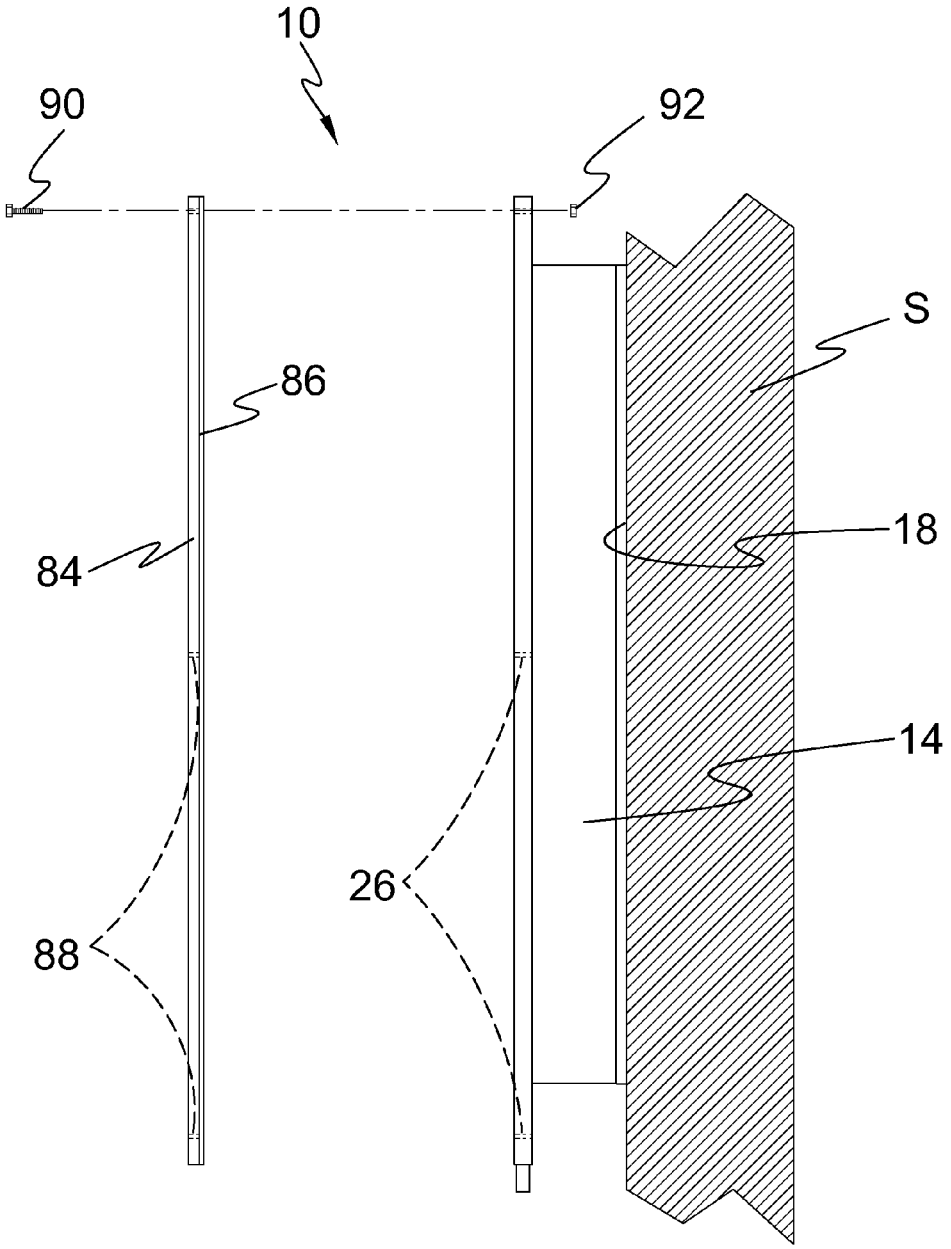
FIG. 11 is a side exploded view of the additional element of the impermeable barrier of the present invention.

Referring to FIG. 11, shown is an exploded side view of the embodiment of the present invention seen in FIG. 10. Barrier frame 14 is attached to the periphery of a door, window, vent, or other opening in structure S with the barrier frame gasket 18 forming a liquid-tight seal thereabout. Plywood frame cover 84 is then placed over frame barrier as seen and secured with mounting bolt 90 and nut 92 through plywood frame cover mounting apertures 88 and barrier frame mounting apertures 26. This forms another fluid resistant seal with plywood frame gasket 86 to protect the interior of structure S from flooding and potential flotsam damage.

Figure 12:
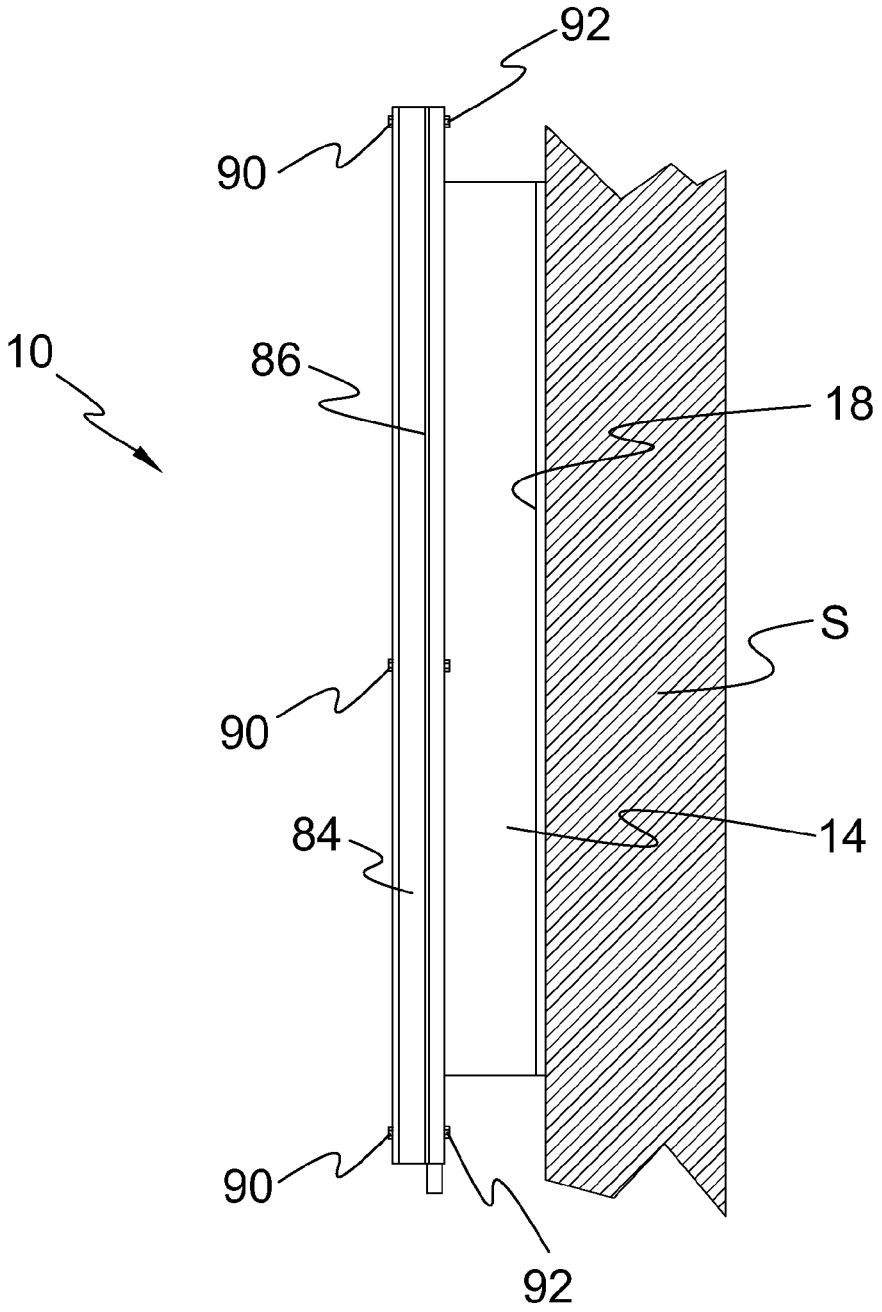
FIG. 12 is a side view of a latched fluid impermeable barrier of the present invention engaged.

Referring to FIG. 12, shown is a side view of the fluid impermeable barrier 10 of the embodiment seen in FIGS. 10 and 11 with the plywood frame cover 84 in place over the frame barrier 14 and secured with mounting bolts 90 and mounting nuts 92. Gaskets 18 and 86 serve to form a liquid resistant seal between both the frame barrier 14 and structure S and frame barrier 14 and plywood frame cover 84.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fluid impermeable barrier for an opening in a structure comprising:

said structure comprising a building having openings comprising windows and doorways in an outer wall thereof;

a barrier frame having a first, inner side and a second, outward side, and a periphery, said barrier frame further including a barrier frame gasket disposed on said first, inner side and where said barrier frame includes mounting means for securing said barrier frame to the periphery of and surrounding each of said openings in the structure such that said barrier frame gasket forms a liquid-tight seal between said outer wall of the structure and said second, outward side of said barrier frame;

said second, outward side of said barrier frame having an outer lip along a periphery thereof;

a removable, single-piece barrier frame cover having a frame cover inner side with a barrier cover gasket disposed thereon, said barrier cover being adapted to fit over said barrier frame second, outward side, said barrier cover gasket making a liquid-tight seal with said second, outward side of said barrier frame;

said barrier frame cover having a U-shaped channel mounted along an upper edge thereof to engage said outer lip of said barrier frame;

compression means mounted on a lower edge of said barrier frame cover for bringing said barrier frame and said barrier frame cover into contact with one another such that said barrier cover gasket forms a liquid-tight seal between said barrier frame cover and said barrier frame, said compression means comprising a hinge lock clip having a handle for deploying said hinge lock clip and a latch for engaging a hinge lock clip extending from a lower edge of said barrier frame outer lip;

whereby said barrier frame with said barrier frame cover installed on said barrier frame form makes a liquid-tight impermeable seal to prevent damage to an interior of the structure by water intrusion through said opening into said structure; and said barrier frame cover being readily mountable on said frame form when needed and readily removable when not needed.

2. The fluid impermeable barrier as claimed in claim 1, where said barrier frame gasket and said frame cover gasket are comprised of flexible polymer material.

3. The fluid impermeable barrier as claimed in claim 2 where said barrier frame mounting means comprises a plurality of apertures adapted to receive mounting bolts.

4. The fluid impermeable barrier as claimed in claim 3 having a security barrier frame containing security bars and wherein said barrier frame further includes means for accommodating said security barrier frame.

5. The fluid impermeable barrier as claimed in claim 3, where said barrier frame further includes a plurality of tabs extending from said periphery of said barrier frame and where said compression means comprises a plurality of hinge lock clips located on said barrier frame cover, said hinge lock clips each including a latch adapted to engage said barrier frame tabs, said compression means having an adjustment for the amount of compression to be applied.

6. The fluid impermeable barrier as claimed in claim 3, where said barrier frame further includes a plurality of latches extending from said periphery of said barrier frame and where said compression means comprises a plurality of cammed engaging members located on said barrier frame cover, said cammed engagement members adapted to engage said latches.

7. The fluid impermeable barrier as claimed in claim 1, where said barrier frame further includes a plurality of tabs extending from the periphery of said barrier frame and where said compression means comprises a plurality of hinge lock clips located on said barrier frame cover, said hinge lock clips each including a latch adapted to engage said barrier frame tabs.

8. The fluid impermeable barrier as claimed in claim 7, where said barrier frame gasket and said frame cover gasket are comprised of flexible polymer material.

9. The fluid impermeable barrier as claimed in claim 8 where said barrier frame mounting means comprises a plurality of apertures adapted to receive mounting bolts.

10. The fluid impermeable barrier as claimed in claim 9 where said barrier frame cover further includes a second outer side, said second, outer side having a plurality of strengthening flanges.

11. The fluid impermeable barrier as claimed in claim 10 where said barrier frame cover is made from plywood.

12. The fluid impermeable barrier as claimed in claim 10 where said barrier cover is made of metal.

13. The fluid impermeable barrier as claimed in claim 10 where said barrier cover is made from a polymer material.

* * * * *